US007215916B2

(12) United States Patent
Kishino et al.

(10) Patent No.: US 7,215,916 B2
(45) Date of Patent: May 8, 2007

(54) ENDLESS METAL BELT, FIXING BELT AND HEAT FIXING DEVICE

(75) Inventors: Kazuo Kishino, Kanagawa (JP); Yaomin Zhou, Saitama (JP); Kohji Sasaki, Saitama (JP); Junichi Takahashi, Saitama (JP); Makoto Miyagi, Saitama (JP); Nobuhiro Arai, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 270 days.

(21) Appl. No.: 10/982,902

(22) Filed: Nov. 8, 2004

(65) Prior Publication Data

US 2005/0100373 A1 May 12, 2005

(30) Foreign Application Priority Data

Nov. 12, 2003 (JP) ..... 2003-382461

(51) Int. Cl.
*G03G 15/20* (2006.01)
*C25D 1/02* (2006.01)
*C25D 1/04* (2006.01)

(52) U.S. Cl. ..... 399/329; 399/333; 428/606; 428/935; 205/73; 205/77

(58) Field of Classification Search ..... None
See application file for complete search history.

(56) References Cited

U.S. PATENT DOCUMENTS 5,608,508 A 3/1997 Kumagai et al. ..... 399/339
5,753,348 A 5/1998 Hatakeyama et al. ..... 428/195
5,765,086 A 6/1998 Kishino et al. ..... 399/329
5,939,337 A 8/1999 Hatakeyama et al. ..... 442/6
6,078,780 A 6/2000 Abe et al. ..... 399/328
6,117,257 A 9/2000 Takahashi et al. ..... 156/86
6,321,062 B1 11/2001 Kitano et al. ..... 399/333
6,377,777 B1 4/2002 Kishino et al. ..... 399/329
6,459,878 B1 10/2002 Tomoyuki et al. ..... 399/331
6,561,001 B2 5/2003 Sakuma et al. ..... 72/85
6,564,033 B2 5/2003 Zhou et al. ..... 399/329
6,782,230 B2 8/2004 Yaomin et al. ..... 399/326

(Continued)

FOREIGN PATENT DOCUMENTS

JP 9-34286 2/1997

(Continued)

OTHER PUBLICATIONS

Machine translation of JP 2002-241984.*
Official Letter/Search Report issued by the European Patent Office in European Application No. 04026744.5 (Jul. 12, 2005).

*Primary Examiner*—John J. Zimmerman
(74) *Attorney, Agent, or Firm*—Fitzpatrick, Cella, Harper & Scinto

(57) ABSTRACT

Objects of the present invention are to provide an endless metal belt superior in flexing resistance and durability, to provide a fixing belt using the endless metal belt, and to provide a heat fixing device with high durability and high reliability. The objects are achieved by the endless metal belt formed of a nickel alloy containing 5% by weight or more of an additional metallic element and having a half-value width of an X-ray diffraction peak in a range of 0.5 degrees to 2 degrees for each of a crystal plane and a crystal plane, and by using the same.

14 Claims, 2 Drawing Sheets

U.S. PATENT DOCUMENTS

| | | | | |
|---|---|---|---|---|
| 2001/0007846 | A1 | 7/2001 | Sakuma et al. | 492/57 |
| 2002/0104351 | A1 | 8/2002 | Sakuma et al. | 72/85 |
| 2002/0146259 | A1 | 10/2002 | Zhou et al. | 399/329 |

FOREIGN PATENT DOCUMENTS

| | | | |
|---|---|---|---|
| JP | 2001-215820 | | 8/2001 |
| JP | 2001-225134 | | 8/2001 |
| JP | 2002-241984 | | 8/2002 |
| JP | 2002-258648 | * | 9/2002 |
| JP | 2004-183033 | * | 7/2004 |
| JP | 2004-183034 | * | 7/2004 |

* cited by examiner

ENDLESS METAL BELT, FIXING BELT AND HEAT FIXING DEVICE

BACKGROUND OF THE INVENTION

1. Field of the Invention

The present invention relates to an endless metal belt, a fixing belt and a heat fixing device (or assembly), which are used in image-forming apparatuses such as an electrophotographic apparatus and an electrostatic recording apparatus.

2. Related Background Art

In an image-forming process such as an electrophotographic process, an electrostatic recording process and a magnetic recording process, a heat fixing device (or assembly) of a belt-heating system is used for forming a permanently fixed image on the surface of a recording material from an unfixed image (a toner image) which is formed on and carried by a recording material (a transfer material sheet, an electrofax sheet, electrostatic recording paper, an OHP sheet, printing paper, format paper and the like), by means of a transfer method or a direct method.

On the other hand, as a heat fixing device of a belt-heating system, a heater heating type is widely proposed and implemented which heats a resin belt or a metal belt having a low heat capacity using a ceramic heater as a heat source. Specifically, the heat fixing device of a belt-heating system of a heat-heating type generally has a nip part formed between a ceramic heater as a heating body and a pressure roller as a pressure member through a heat resistant belt (a fixing belt); makes a recording material having an unfixed toner image carried thereon introduced between the fixing belt and the pressure roller; while sandwiching the recording material between the fixing belt and the pressure roller, and transporting it along with the fixing belt, gives the heat of the ceramic heater to the recording material through the fixing belt in the nip part; and heat-fixes the unfixed toner image on the recording material with the heat and an applied pressure in the nip part.

The heat fixing device of a belt-heating system of a heater heating type can constitute an on-demand type device by using a member with a low heat capacity for the fixing belt. Specifically, the fixing device has only to heat a ceramic heater of a heat source to a predetermined fixing temperature by applying an electric current to the heater, only when an image-forming apparatus carries out image formation, has a short waiting time after the image-forming apparatus is powered on until it comes to an image-forming ready condition (a quick starting property), and has a power consumption largely reduced during a stand-by period (capable of saving power), which are advantageous.

As for a fixing belt used in such a heat fixing device of a belt-heating system of a heater heating type, it is proposed to use a fixing belt employing a metal for the base material.

A fixing belt using a metal as a base material generally employs a seamless metal such as SUS or nickel, and a well-known seamless belt made from a SUS material is produced by a plastic forming method such as spinning (for instance, see Japanese Patent Application Laid-Open No. 2001-225134). A seamless belt made from a nickel material is generally produced by electroforming in a nickel sulfamate bath or a nickel sulfate bath (for instance, see Japanese Patent Application Laid-Open No. H09-034286 and 2001-215820).

Generally, in the present circumstances, an SUS belt made by a plastic forming method (rolling, drawing, spinning or the like) cannot cope with tendencies of a decreasing diameter (a diameter of 18 mm or smaller) for a fixing belt, and thinning (a thickness of 15 μm or less) for a base material of the fixing belt, which are required by a small-sized, high-speed and more durable fixing device. Specifically, the SUS belt has a different stress distribution in an MD direction from that in a TD direction, so that the SUS material is feared to cause cracking due to the uniaxial orientation of the axes of the crystals.

On the other hand, in an electroformed nickel belt, there has been a tendency that heat resistance has been thought much of and strength and abrasion resistance have been sacrificed. For this reason, a fixing belt produced with the use of such an electroformed nickel belt usually had a sliding layer made from polyimide provided on a sliding surface. However, because a so-called resin-based material starting with polyimide has a heat conductivity of approximately 300 times lower than that of a nickel material, a heat fixing device using such a material needs a long rise time and hides the merits of a nickel material having high heat conductivity.

An electroformed belt from a single metal hardly has the performance satisfying all demands such as yield strength, abrasion resistance and flexing resistance. For this reason, Japanese Patent Application Laid-Open No. 2002-241984 proposes a method for producing an electroformed belt containing various metallic elements in combination and having more excellent characteristics. For instance, an electroformed nickel belt is disclosed which contains 10 to 10,000 ppm (1% by weight) by weight proportion, at least one metallic element belonging to the groups of 2, 3, 4 and 5 in the periodic table. The metallic elements in the groups of 2 to 5 in the periodic table have such characteristics as to control the growth of plated nickel crystals, systematically grow the crystals and promote the orientation, have the effect of inhibiting coarsening of the plated nickel crystals due to heat, and thereby are assumed to provide the electroformed nickel belt the hardness of which hardly lowered even by heat aging and which is superior in heat resistance.

In addition, Japanese patent Application Laid-Open No. 2002-241984 discloses that when the electroformed nickel belt contains more than 10,000 ppm (1% by weight) of metallic elements in the groups of 2 to 5 in the periodic table by weight proportion, the metallic elements tend to precipitate in grain boundaries and make the electroformed nickel belt fragile.

Actually, many electroplated coatings of binary and ternary alloys are industrially widely used for machine parts and electronic components. The mechanical and electrical characteristics of the electroplated coatings of the alloys are closely connected with the composition. Furthermore, the existing state of an alloying element (such as a compound, a crystalloid and a solid solution) affects the characteristics (hardness, flexibility, stress in electrodeposits and the like) of the electroplated coatings of the alloys.

A fixing belt used in a heat fixing device must have durability for a long time. Furthermore, requirements for energy saving and space saving become severer, the miniaturization and speedup of a heat fixing device used in an image-forming apparatus, the reduction in the diameter of a fixing belt, and the thinning of a metal belt are promoted, and based on this, the metal belt having adequate abrasion resistance and superior characteristics such as flexing resistance, flexibility and durability, is demanded.

In a heat fixing device of a belt-heating system of an electromagnetic induction heating type for directly heating a metal belt by electromagnetic induction as well, the miniaturization and speedup of the heat fixing device, a reduction in the diameter of a fixing belt, and the wall-thinning of the metal belt are also promoted, and based on this, the metal belt having adequate abrasion resistance and superior characteristics in terms of flexing resistance, flexibility and durability, is demanded.

SUMMARY OF THE INVENTION

An object of the present invention is to provide an endless metal belt having more excellent flexing resistance, flexibility and durability than the conventional endless metal belt made of a nickel alloy has. In addition, other objects of the present invention are to provide a fixing belt making use of the endless metal belt, and to provide a heat fixing device making use of the fixing belt as a fixing member.

The present invention provides an endless metal belt comprising a nickel alloy, wherein the nickel alloy contains 5% by weight or more of an additional metallic element, and has a half-value width of an X-ray diffraction peak (a peak width at half height of an X-ray diffraction peak) in a range of from 0.5 degrees to 2 degrees for each of a crystal plane (111) and a crystal plane (200).

In addition, the present invention provides a fixing belt having a metal belt layer which is the endless metal belt according to the present invention.

Furthermore, the present invention provides a heat fixing device for heat-fixing an unfixed image held on a recording material in a nip part formed between a pair of fixing members at least one of which has a belt shape, while sandwiching and transporting the recording material, wherein the fixing member having a belt shape is the fixing belt according to the present invention.

The present invention makes the nickel alloy of an endless metal belt made from the nickel alloy containing 5 by weight or more of an additional metallic element have a half-value width of an X-ray diffraction peak of 0.5 degrees to 2 degrees for both of a crystal plane (111) and a crystal plane (200), and thereby can provide an endless metal belt of high quality having superior flexing resistance, adequate durability and fixing property, provide a fixing belt making use of it, and provide a heat fixing-device provided with the fixing belt.

BRIEF DESCRIPTION OF THE DRAWINGS

FIG. 5A is a diagram in the case of no internal stress being applied, FIG. 5B in the case of a macroscopic internal stress being applied, and FIG. 5C in the case of microscopic internal stress being applied.

DESCRIPTION OF THE PREFERRED EMBODIMENTS

Embodiments of the present invention will be now further described.

Fixing Belt

Figure 1:
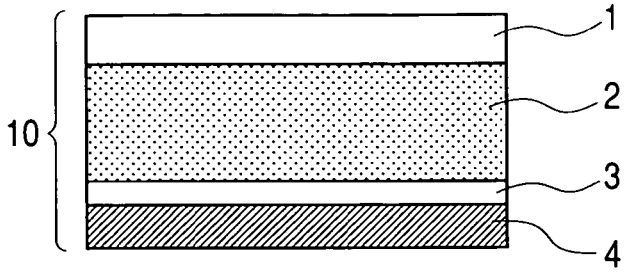
FIG. 1 is a schematic diagram for describing a layer structure of a fixing belt in one embodiment according to the present invention.

FIG. 1 is a schematic diagram for describing a layer structure of a fixing belt 10 in one embodiment according to the present invention. The fixing belt 10 according to the present invention has a metal belt layer 1 constituted by an endless metal belt according to the present invention, which will be described below, an elastic layer 2 provided on the outer circumferential surface of the metal belt layer 1, and a release layer 4 coated on the elastic layer 2 through an adhesive layer 3. In the fixing belt 10, the side of the metal belt layer 1 corresponds to the inner circumferential surface side (a belt guide face side) of the fixing belt 10, and the side of the release layer 4 corresponds to the outer circumferential surface side (a pressure roller face side) of the fixing belt 10. A primer layer (not shown) may be formed between the metal belt layer 1 and the elastic layer 2, in order to improve adhesiveness. The primer layer (not shown) may employ a well-known primer such as silicone base, an epoxy base and a polyamideimide base primers, and has usually a thickness of around 1 to 10 μm. A metal belt layer 1 constituted by the endless metal belt according to the present invention has sufficient abrasion resistance, so that the inner face side (the belt guide face side) of the metal belt layer 1 can be made directly a sliding face, but an independent sliding layer may be provided. As needed, a sliding layer (not shown) made of a resin such as polyimide may be formed on the inner face side of a metal belt layer 1.

Figure 2:
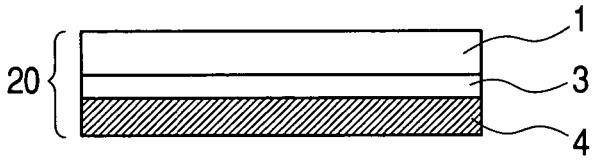
FIG. 2 is a schematic diagram for describing a layer structure of a fixing belt in another embodiment according to the present invention.

FIG. 2 is a schematic diagram for describing a layer structure of a fixing belt 20 in another embodiment according to the present invention. The fixing belt has no elastic layer formed on the outer surface side of a metal belt layer 1, and has a release layer 4 formed on a metal belt layer 1 through an adhesive layer 3. A fixing belt free from such an elastic layer can be used particularly for a fixing belt of a heat fixing device for a monochromatic image where the toner transferred on a recording material is in a small amount and the unevenness of a toner layer is comparatively small, and for a fixing belt for exclusive use of heating.

Figure 3:
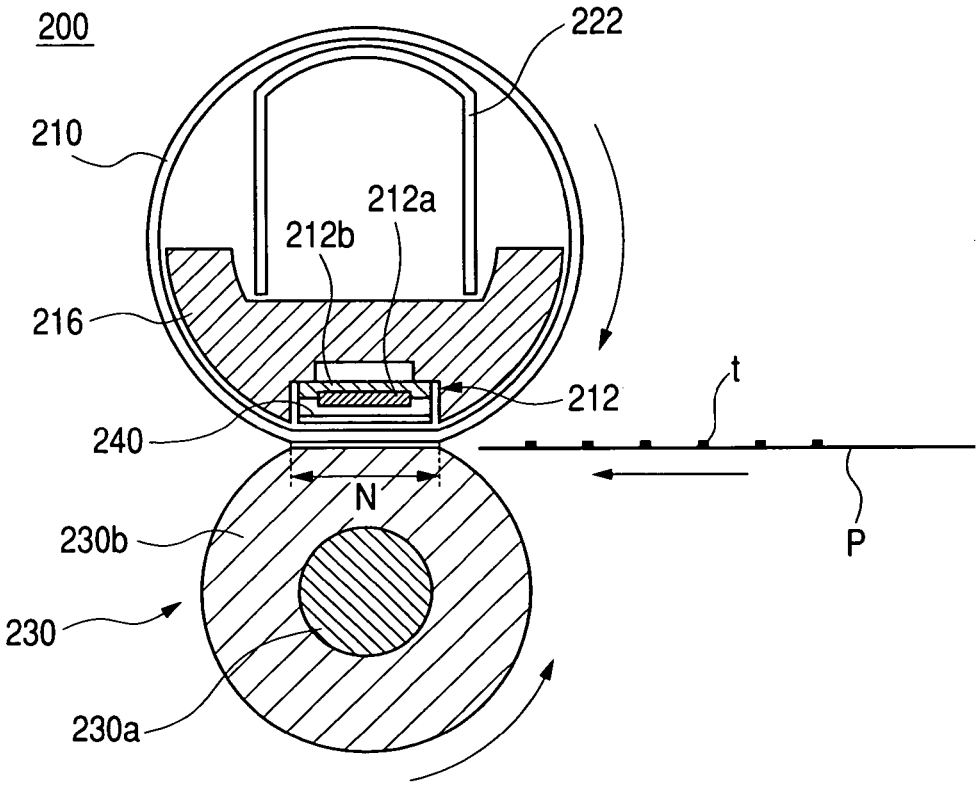
FIG. 3 is a schematic diagram showing a cross section of a heat fixing device in one embodiment according to the present invention.
Figure 4:
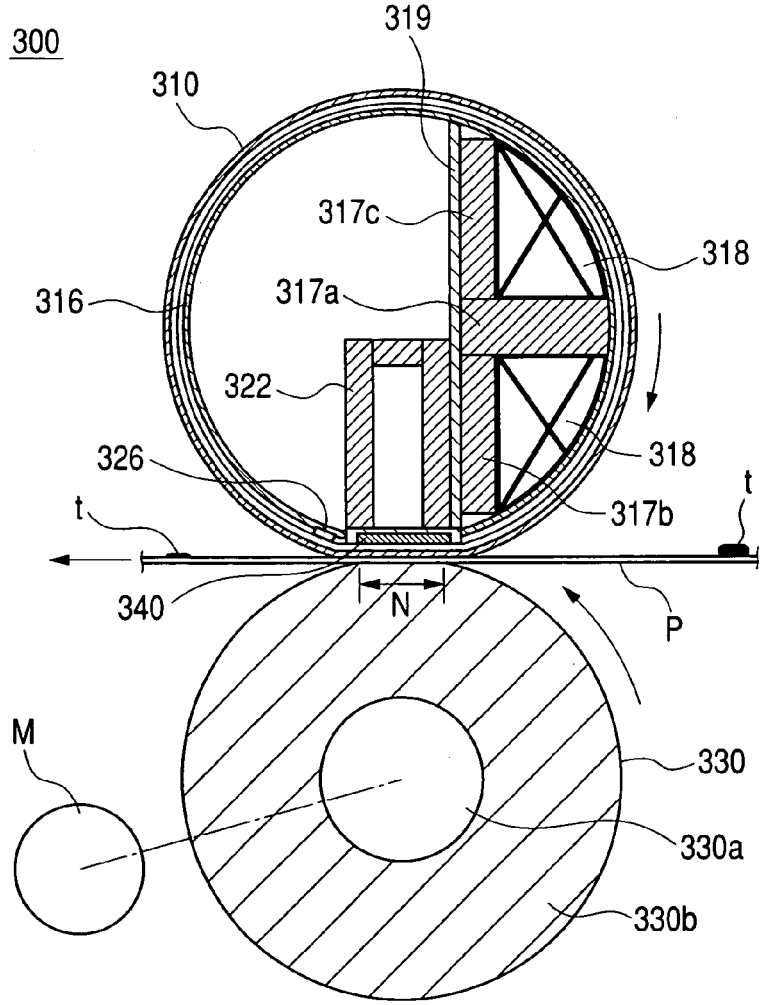
FIG. 4 is a schematic diagram showing a cross section of a heat fixing device in another embodiment according to the present invention.

The metal belt layer 1 of the fixing belt 10 or 20 can adequately perform physical and mechanical functions even when used for either of the heat fixing device of a belt-heating system of a heater heating type with the use of a ceramic heater or the like (FIG. 3), and the heat fixing device of a belt-heating system of an electromagnetic induction heating type (FIG. 4).

Endless Metal Belt

The endless metal belt according to the present invention is an endless metal belt comprising a nickel alloy. The nickel alloy contains 5% by weight or more of an additional metallic element, and has a half-value width of an X-ray diffraction peak in a range of from 0.5 degrees to 2 degrees for each of a crystal plane (111) and a crystal plane (200). The above described nickel alloy may preferably contain at least one non-metallic element selected from the group consisting of sulfur and carbon.

An endless metal belt according to the present invention may preferably be produced by electroforming, for instance, produced by immersing a cylindrical master block made from stainless steel or the like in an electrolytic bath, making the master block as a cathode, forming a film comprising a nickel alloy having the above described composition on the outer or inner circumferential surface of the master block by an electroforming process, and peeling the film off from the master block.

An electrolytic bath used in the above method can-be well-known nickel electrolytic baths such as a nickel sulfamate bath or a nickel sulfate bath containing necessary additional metallic element.

The additional metallic element contained in the nickel alloy may include, for instance, Co, Mn, Sn, W, Cu and Zn. The additional metallic element may preferably be contained in an amount of 5 to 50% by weight, more preferably 10 to 40% by weight based on the total weight of the nickel alloy. When the additional metallic element is in a content of 5% by weight or more, the nickel alloy constituting an endless metal belt can develop the solid solution effect, and can show a half-value width of an X-ray diffraction peak in a range of 0.5 degrees to 2 degrees for each of a crystal plane (111) and a crystal plane (200). The solid solution effect improves the flexing resistance and the durability of the nickel alloy. When the nickel alloy contains 50% by weight or less of the additional metallic element, it preferably can secure flexibility suitable for a belt.

In order to introduce the additional metallic element into an endless metal belt according to the present invention, a compound of, for instance, Co, Mn, Sn, Cu, Zn or the like may be added to the electrolytic bath. Depending on the nature of the compound to be used, the compound may usually be added so that the concentration of the additional metallic element can be 1 to 300 g/l, when the concentration of nickel is made 450 g/l.

In addition, the above described nickel alloy, in the present invention, may preferably contain further at least one non-metallic element selected from the group consisting of sulfur and carbon. The non-metallic element may preferably be contained in an amount of 0.002% by weight to 0.05% by weight, and more preferably of 0.005% by weight to 0.03% by weight based on the total weight of the nickel alloy. When the non-metallic element is in a content of 0.002% by weight or more, the alloy has surface smoothness improved. When the non-metallic element is in a content of 0.05% by weight, the alloy can preferably secure heat resistance.

In order to introduce the non-metallic element into the nickel alloy constituting an endless metal belt according to the present invention, a compound such as saccharin sodium and butynediol may be added to the electrolytic bath. Depending on the kind of a compound to be used, the compound may usually be added so that the concentration of the non-metallic element can be 0.01 to 0.5 g/l, when the concentration of nickel is 450 g/l.

The electrolytic bath may appropriately contain additives such as a pH adjuster, a pitting prevention agent and a brightening agent.

The pH adjuster usable in the present invention may include, for instance, nickel chloride, nickel sulfate and sulfuric acid.

The pitting prevention agent may include, for instance, a sulfuric acid ester of lauryl alcohol such as sodium lauryl sulfate, and sodium laurate and sodium naphthalenedisulfonate.

The brightening agent may include a so-called stress-reducing agent and/or a primary brightening agent such as saccharin, saccharin sodium, sodium benzenesulfonate and sodium naphthalenesulfonate, and a so-called secondary brightening agent such as butynediol, cumarin and diethyltriamine.

A specific example of an electrolytic bath usable for producing an endless metal belt according to the present invention may include a nickel electrolytic bath, when the additional metallic element is cobalt for instance, composed of 400 to 650 g/l of nickel sulfamate, 0 to 60 g/l of nickel chloride, 80 g/l of cobalt sulfamate and 20 to 55 g/l of boric acid.

An endless metal belt according to the present invention is made from a nickel alloy that shows a half-value width of an X-ray diffraction peak in a range of 0.5 degrees to 2 degrees for each of a crystal plane (111) and a crystal plane (200), in an X-ray diffraction pattern which is obtained by plotting the X-ray diffraction intensity of the nickel alloy of the endless metal belt, against a diffraction angle of 2θ. An endless metal belt made from a nickel alloy showing a half-value width of an X-ray diffraction peak in a range of 0.5 degrees to 2 degrees for both of a crystal plane (111) and a crystal plane (200) has high strength and high hardness, shows superior flexing resistance due to the solid solution effect, can be used for producing a small-diameter fixing belt requiring flexing resistance characteristics and can secure higher durability.

The above described solid solution effect of the nickel alloy constituting the endless metal belt according to the present invention is considered to be partly an effect by an interstitial solid solution, but mainly be a substitutive solid solution effect which appears by a phenomenon that a metallic element other than nickel substitutes for atoms in the crystal lattice of metallic nickel and forms a solid solution or a supersaturated solid solution.

An interstitial solid solution is formed in such a manner that solute atoms with small atomic diameters, such as carbon, nitrogen and hydrogen atoms, go into gaps of crystal lattices formed by parent phase atoms having the remarkably larger atomic diameters than them.

A substitutive solid solution is formed in such a manner that a solute atom having almost the same atomic diameter as, in other words, having little different atomic diameter from, that of a parent phase atom, is substituted at one part of the lattice points of the crystal lattices formed by parent phase atoms.

In general, it is known that the internal stress of a nickel alloy according to the present invention includes two kinds, one of which is an internal stress caused by distortion such as elasticity retraction or extension of crystal lattices of a parent phase metal, due to a macroscopic stress such as an external force working on the nickel alloy, and the other of which is a microscopic internal stress caused by the invasion of a solute to a crystal lattice gap in a minute region and/or the substitution of atoms in crystal lattice points. The condition of the distortion in crystal lattices by these internal stresses can be known from an X-ray diffraction pattern.

Figure 5A:
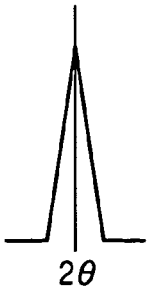
FIGS. 5A, 5B and 5C are schematic diagrams showing changes of X-ray diffraction peaks by internal stress, where
Figure 5B:
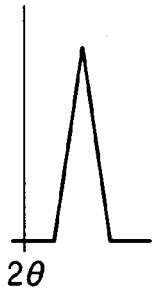
Figure 5C:
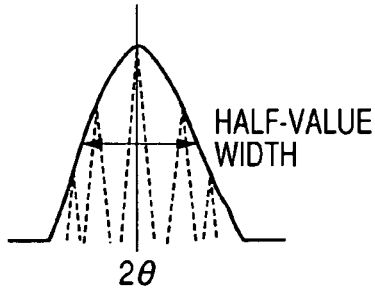

For instance, FIGS. 5A to 5C schematically shows X-ray diffraction peaks of a nickel alloy on which an internal stress does not work, and of a nickel alloy under the influence of the above described internal stress. When FIG. 5A is supposed to be an X-ray diffraction peak for a crystal plane in a nickel alloy in a state of receiving no internal stress, the X-ray diffraction peak for the above described crystal plane of the nickel alloy under the effect of the internal stress due to macroscopic stress shows a peak, as shown in FIG. 5B, in a deviated peak position to left or right from the position shown in FIG. 5A. This indicates that the distances between the above described crystal planes are uniformly compressed or extended by the macroscopic stress over a macroscopic range. On the other hand, the X-ray diffraction peak for the above described crystal plane of the nickel alloy under a microscopic internal stress does not show a shift of the position of the X-ray diffraction peak, but shows a widened half-value width, as shown in FIG. 5C. This indicates that the crystal lattices of the nickel alloy are shrunk, and on the other hand, are extended in a microscopic region by a microscopic internal stress. For this reason, the half-value width of an X-ray diffraction peak increases as the microscopic internal stress increases.

An endless metal belt made from a nickel alloy under a microscopic stress in an appropriate range improves the hardness, the yield strength and the flexing resistance. Accordingly, when the half-value width of an X-ray diffraction peak is in a predetermined range, the endless metal belt improves the characteristics, particularly the yield strength and the flexing resistance.

The characteristics of a nickel alloy constituting an endless metal belt produced by electroforming, particularly the characteristics such as the yield strength and the flexing resistance are affected by an electroforming condition. In an electroforming process according to the present invention, by controlling a cathode current density, an electrolytic bath pH-value, the concentration of a brightening agent added, and an electrolytic bath temperature along with controlling an electrolytic bath composition, an endless metal belt made from a nickel alloy having a desired alloy composition and half-value width of an X-ray diffraction peak can be obtained.

In the present invention, an electroforming process, depending on an electrolytic bath, for instance, having a cathode current density controlled to usually 1 to 30 A/dm$^2$, and preferably 5 to 15 A/dm$^2$, an electrolytic bath pH-value controlled, for instance, to usually 2.5 to 9, and preferably 3.5 to 4.5, and an electrolytic bath temperature controlled to usually 30 to 65° C., and preferably 45 to 55° C., makes a nickel alloy constituting an endless metal belt contain 5% by weight or more of an additional metallic elements, and have a half-value width of an X-ray diffraction peak in a range of 0.5 degrees to 2 degrees for both of a crystal plane (111) and a crystal plane (200), and thereby can provide an endless metal belt having superior flexing resistance as well as high hardness and high strength, due to a solid solution effect. Thus, the obtained endless metal belt, even when used in a small-diameter fixing belt severely requiring flexing resistance and a heat fixing device using it, can reliably secure high durability.

For the purpose of lowering a heat capacity to improve a quick start property, the thickness of an endless metal belt may preferably be 10 to 100 μm, and more preferably 15 to 60 μm. An endless metal belt with the thickness of 10 μm or more, when the endless metal belt is produced or when a fixing belt using it is produced, does not cause a crease, and an endless metal belt with the thickness of 100 μm or less can be produced into a fixing belt having superior movability and flexing resistance. The present invention can easily produce an endless metal belt with a small wall thickness of 10 μm or thicker and 25 μm or thinner, and also can easily produce a fixing belt having a metal belt layer with a small layer thickness constituted by such an endless metal belt with a small wall thickness.

Elastic Layer

A fixing belt according to the present invention may be or may not be provided with an elastic layer 2. When an elastic layer 2 is provided, the elastic layer 2 covers an image to be heated and reliably transfers heat to the image in a nip part, and alleviates the fatigue of the fixing belt due to rotation and inflection through compensating a restoring force of the metal belt layer. In addition, the provided elastic layer 2 can increase followability of the release layer surface of the fixing belt to the unfixed toner image surface, and can efficiently transfer the heat to the toner image surface. A fixing belt provided with the elastic layer 2 is particularly suitable for heat fixing of a color image having a lot of unfixed toner transferred on the recording material.

The material of an elastic layer 2 is not particularly limited but has only to have good heat resistance and good thermal conductivity. The elastic layer 2 is preferably made from a silicone rubber, a fluorine-containing rubber and fluorosilicone rubber, and is more preferably formed from the silicone rubber.

The silicone rubber for forming an elastic layer 2 can include polydimethylsiloxane, polymethyltrifluoropropylsiloxane, polymethylvinylsiloxane, polytrifluoropropylvinylsiloxane, polymethylphenylsiloxane and polyphenylvinylsiloxane, and a copolymer containing a monomeric unit constituting these polysiloxanes.

As needed, the elastic layer 2 may contain a reinforcing filler such as fumed silica and precipitated silica, and calcium carbonate, quartz powder, zirconium silicate, clay (aluminum silicate), talc (water-containing magnesium silicate), alumina (aluminum oxide) and colcothar (iron oxide).

The thickness of the elastic layer 2 may, in order to obtain a fixed image of adequate quality, preferably be 10 to 1,000 μm, and more preferably 50 to 500 μm. The thickness of 1,000 μm or less of the elastic layer 2 preferably decreases the heat resistance of the elastic layer.

When a color image, particularly photographic image is printed, a solid image may be formed in some cases across a wide area on a recording material P. In such a case, when a heating plane (a release layer 4) cannot follow the surface unevenness of the recording material or that of an unfixed toner image, heating unevenness may occur, thereby causing the difference of gloss in images between parts receiving much heat and little heat. Usually, a part receiving much heat presents high glossiness, and a part receiving little heat presents low glossiness. When the elastic layer 2 is too thin, the heating plane cannot follow the surface unevenness of the recording material or the unfixed toner image so that the unevenness of the gloss may occur in images. In contrast to this, when the elastic layer 2 is too thick, the elastic layer 2 has high thermal resistance so that quick start may hardly be realized.

The hardness of the elastic layer 2 (JIS-K-6253 (ISO-7619) established in 1993 so as to match an international standard) may, in order to adequately inhibit the unevenness of the gloss on images from occurring and obtain adequate quality of a fixed image, preferably be 1 to 60 degrees, and more preferably 5 to 45 degrees.

The thermal conductivity λ of the elastic layer 2 is preferably $2.5\times10^{-3}$ [W/cm·° C.] to $5.0\times10^{-2}$ [W/cm·° C.], and more preferably $5.0\times10^{-3}$ [(W/cm·° C.]to $3.0\times10^{-2}$ [W/cm·° C.]. When the thermal conductivity λ is too low, the thermal resistance of the fixing belt becomes too high, and temperature-rise in a surface layer (a release layer 4) of the fixing belt may become slow. When the thermal conductivity λ is too high, the hardness of the elastic layer 2 may become high, and permanent compression set may become large.

An elastic layer 2 may be formed by well-known methods such as a method of coating a material such as a liquid silicone rubber on the outer circumferential surface of an endless metal belt in a uniform thickness by means of a blade coating method or the like and heat-hardening the material; a method of injecting a material such as the liquid silicone rubber into a forming die and vulcanizing and hardening the material; a method of vulcanizing and hardening the material after extrusion; and a method of vulcanizing and hardening the material after injection molding.

Release Layer

A material of forming a release layer 4 is not particularly limited but has only to have adequate release properties and heat resistance. The material of forming a release layer 4 is preferably a fluorine resin such as PFA (a copolymer of tetrafluoroethylene with a perfluoroalkylether), PTFE (polytetrafluoroethylene) and FEP (a copolymer of tetrafluoroethylene with hexafluoropropylene), and a silicone resin, a fluorosilicone rubber, a fluorine-containing rubber and a silicone rubber, and of these, PFA is more preferable. In addition, as needed, a release layer 4 may contain an electroconducting agent such as carbon and tin oxide. The content of the electroconducting agent is not limited in particular, but in general it is preferably 10% by weight or less based on the weight of a release layer 4.

The thickness of a release layer 4 is usually preferably 1 to 100 μm. When the release layer 4 is too thin, the release layer may have a part of poor release properties due to coating unevenness of a coated film, and may lack in durability. In contrast to this, when a release layer is too thick, the thermal conductance may be insufficient. Particularly, in case of a release layer made from a resin, heat transferability and flexibility may be lowered so that adequate heat transfer may not be done, and functions such as a function of alleviating fatigue due to rotation and inflection, which the elastic layer 2 has, may not be fulfilled.

In the present invention, a release layer can be formed by a well-known method. For instance, when a release layer of a fluorine-based resin is formed on an elastic layer, the release layer is formed by coating the elastic layer with a liquid having a fluorine resin powder dispersed therein, drying and baking the coated liquid. In addition, when a release layer of a fluorine-based resin is formed on a metal belt, the release layer can be formed by coating a liquid having a fluorine resin powder dispersed therein, on an adhesive layer of an endless metal belt having the adhesive layer previously formed thereon, or directly on the endless metal belt, and drying and baking the coated liquid. Alternatively, the release layer can be formed by a method of covering the endless metal belt with a fluorine resin previously formed into a tube shape, and bonding the resin to the metal belt. When a release layer of a rubber-based material is formed, it can be formed by a method of injecting a liquid material into a forming die, and vulcanizing and hardening the material; a method of vulcanizing and hardening the material after extrusion; and a method of vulcanizing and hardening the material after injection molding.

In addition, an elastic layer and a release layer can be simultaneously formed by fitting a tube having a primer previously coated on the inner face and an endless metal belt according to the present invention having a primer previously coated on the surface in a cylindrical master block, injecting, for instance, a liquid silicone rubber into a gap between the above described tube and the above described endless metal belt, and hardening the silicone rubber by heating to bond them.

When a sliding layer is provided on a fixing belt according to the present invention, the material of the sliding layer is not limited in particular, and has only to have high heat resistance and high strength and provide a smoothed surface, but usually the sliding layer may preferably be formed of a polyimide resin.

In addition, as needed, the sliding layer may contain a sliding agent. The usable sliding agent includes a fluorine resin powder, graphite and molybdenum disulfide.

The thickness of a sliding layer is usually preferably 5 to 100 μm, and more preferably 10 to 60 μm. When a sliding layer is too thick, the heat capacity of a fixing belt becomes large and the rise time occasionally becomes long.

The sliding layer can be formed by such a well-known method, for instance, as a method of coating the inner surface of a metal belt layer with a liquid material, followed by drying and hardening, or a method of bonding a material previously formed into a tube shape, to a metal belt layer.

In the next place, the embodiments of a heat fixing device according to the present invention will be described.

Heat Fixing Device

The heat fixing device according to the present invention is a heat fixing device for heat-fixing an unfixed toner image held on a recording material in a nip part formed between a pair of fixing members at least one of which has a belt shape, while sandwiching and transporting the recording material, wherein as the fixing member having a belt shape is used a fixing belt according to the present invention. Specifically, the heat fixing device according to the present invention includes, for instance, a heat fixing device of a belt-heating system of a heater heating type, and a heat fixing device of a belt-heating system of an electromagnetic induction heating type, which will be described blow.

FIG. 3 is a schematic diagram showing a cross section of a heat fixing device in one embodiment according to the present invention. The heat fixing device 200 is a heat fixing device of a belt-heating system of a heater heating type making use of a ceramic heater as a heating body. The heat fixing device 200 has a fixing belt 210 as a fixing member having a belt shape, and the fixing belt 210 is the above described fixing belt according to the present invention. The fixing belt 210 is preferably a fixing belt having a small diameter used in a heat fixing device of a belt-heating system. Specifically, the diameter is preferably 30 mm or smaller.

A belt guide 216 has heat resistance and heat insulating properties. A ceramic heater 212 as a heating body is fitted into a channel longitudinally formed along the guide in the approximately central part of the lower part of the belt guide 216, and fixed to and supported by the channel. On the other hand, the endless fixing belt 210 according to the present invention is loosely fitted to the outside of the belt guide 216, and is held into an approximately cylindrical shape.

The other fixing member of the above described pair of the fixing members is a pressure member 230, and in the present embodiment, the pressure member 230 is a pressure roller having an elastic layer. The pressure member 230 has: an elastic layer 230*b* of a material such as silicone rubber provided on the outer circumferential surface of a mandrel 230*a*. The mandrel 230*a* is appropriately disposed in such a manner that both ends of the mandrel are rotatably held in a bearing between the unshown chassis side plates of the front side and backward side of the heat fixing device. The pressure roller having an elastic layer may further have, in order to improve the surface characteristics, a fluorine resin layer such as of PTFE (polytetrafluoroethylene), PFA (a copolymer of tetrafluoroethylene with a perfluoroalkyl ether) and FEP (a copolymer of tetrafluoroethylene with hexafluoropropylene), on the outer circumferential part of the elastic layer.

A pressing rigid stay 222 is arranged so as to pass through the inner side of the belt guide 216.

Between both the ends of the pressing rigid stay 222 and spring shoe members (not shown) on the chassis side of the device, each pressure spring (not shown) is contracted and installed, and makes the pressing rigid stay 222 exert a depressing force. Thereby, the lower surface of a sliding plate 240 arranged on the lower surface of the ceramic heater 212 and the upper surface of the pressure roller 230 are compressed to each other while sandwiching the fixing belt 210, and form a nip part N having a predetermined width.

A material used in producing a belt guide 216 preferably includes a resin superior in heat resistance, such as a heat resistant phenol resin, a LCP (liquid crystalline polyester) resin, a PPS (polyphenylene sulfide) resin and a PEEK (polyetheretherketone) resin.

The pressure roller 230 is rotationally driven by a driving means (not shown) in a counterclockwise direction, as shown by an arrow. By friction between the pressure roller 230 and the external surface of the fixing belt 210, caused by the rotational drive of the pressure roller 230, a rotating force acts on the fixing belt 210, and the fixing belt 210 rotates outside the belt guide 216, while the inner face slides so as to be in close contact with the lower surface of a ceramic heater 212 in the nip part N as shown by an arrow, in a clockwise direction, at a peripheral velocity corresponding to the rotational peripheral velocity of the pressure roller 230 (a pressure roller drive system).

The pressure roller 230 starts rotating on the basis of a print-starting signal, and the ceramic heater 212 starts heating. When the rotation peripheral velocity of the fixing belt 210 caused by the rotation of the pressure roller 230 reaches a steady state, and the temperature of the ceramic heater 212 reaches a predetermined temperature, a recording material P, which carries a toner image t as a material to be heated, is introduced between the fixing belt 210 and the pressure roller 230 in the nip part N, with the toner image-carrying side directed to the fixing belt 210 side. Then, the recording material P is brought into close contact with the lower surface of the ceramic heater 212 in the nip part N through the fixing belt 210, and moves and passes through the nip part N together with the fixing belt 210. In the moving and passing process, the heat of the ceramic heater 212 is given to the recording material P through the fixing belt 210, and the toner image t is heat-fixed on the recording material P. The recording material P which has passed through the nip part N is separated from the external surface of the fixing belt 210, and is carried away.

The ceramic heater 212 as the heating body is an oblong linear heating body with a low heat capacity, of which the longitudinal direction is perpendicular to the moving direction of the fixing belt 210 and the recording material P. The ceramic heater 212 is basically constituted by a heater substrate made from aluminum nitride or the like; a heat generation layer 212*a* arranged on the surface of the heater substrate along the longitudinal direction, specifically, the heat generation layer 212*a* having a resistive material, for instance, such as Ag/Pd (silver/palladium) coated and provided thereon into a size of about 10 μm thick and 1 to 5 mm wide by screen printing; and a protective layer 212*b* of a material such as glass and fluorine resin further provided thereon. In addition, a usable ceramic heater is not limited to such a heater.

The heat generation layer 212*a* of the ceramic heater 212 generates heat when an electric current is applied between both ends of the heat generation layer 212*a*, to rapidly raise the temperature of the heater 212. The temperature of the heater is detected by a temperature sensor (not delineated), the electric current conduction to the heat generation layer 212*a* is controlled by a control circuit (not shown) so that the heater can be kept at a predetermined temperature, and the temperature of the ceramic heater 212 is adjusted and controlled.

A ceramic heater 212 is fitted into a channel longitudinally formed along the guide in the approximately central part of the lower part of the belt guide 216, with a protective layer 212*b* side upward, and fixed to and supported by the channel. In the nip part N coming into contact with the fixing belt 210, the face of the sliding plate 240 of the ceramic heater 212 and the inner surface of the fixing belt 210 are brought into contact with each other and mutually slided. The width of the nip part is changed in correspondence with the process speed, so as to secure residence time in the nip part of the recording material P. The width of the nip part is preferably set to 5 mm or more for the process speed of 100 mm/sec or more.

FIG. 4 is a schematic diagram showing a cross section of a heat fixing device in another embodiment according to the present invention. A heat fixing device 300 is a heat fixing device of a belt-heating system of an electromagnetic induction heating type, and the fixing belt is a fixing belt according to the present invention as described above.

In the heat fixing device 300, a magnetic field-generating means is constituted by a magnetic cores 317*a*, 317*b* and 317*c*, and an exciting coil 318.

The magnetic cores 317*a* to 317*c* are members with high magnetic permeability, and the usable material is preferably a material used for the core of a transformer, such as ferrite and permalloy, and particularly ferrite is preferable which causes little loss even in 100 kHz or higher.

An exciting coil 318 employs a bundle of several copper thin wires (a strand) each of which is insulation-coated as a conductor (an electric wire) constituting the coil, and is formed by winding them into a plurality of turns. In the present embodiment, the exciting coil 318 is formed by winding the strand into 11 turns.

The insulating coating preferably employs a coating material with heat resistance, in consideration of thermal conduction of a generated heat in a fixing belt 310. For instance, a material coated with a polyimide resin or the like is preferably used. Here, an exciting coil 318 may be compacted by pressure from the outside.

An insulating member 319 is disposed between a magnetic field-generating means and a pressing rigid stay 322. The material of the insulating member 319 should preferably be superior in insulation properties and heat resistance. The material preferably includes, for instance, a phenol resin, a fluorine resin, a polyimide resin, a polyamide resin, a polyamideimide resin, a PEEK (polyetheretherketone) resin, a PES (polyethersulfone) resin, a PPS (polyphenylene sulfide) resin, a PFA (a copolymer of tetrafluoroethylene with a perfluoroalkyl ether) resin, a PTFE (polytetrafluoroethylene) resin, a FEP (a copolymer of tetrafluoroethylene with hexafluoropropylene) resin, and a LCP (liquid crystalline polyester) resin.

The exciting coil 318 has an excitation circuit (not shown) connected to a feeding portion (not shown). The excitation circuit (not shown) can preferably generate a high-frequency power in 20 to 500 kHz by a switching power supply. The exciting coil 318 generates an alternating magnetic flux by an alternating current (a high-frequency current) supplied from the excitation circuit (not shown).

The alternating magnetic flux (C) introduced in magnetic cores 317*a* to 317*c* generates an eddy current in a metal belt layer (an electromagnetic induction heat-generation layer) 1 (FIGS. 1 and 2) of a fixing belt 310. The eddy current generates Joule heat (eddy current loss) in the metal belt layer 1 (an electromagnetic induction heat-generation layer) due to the specific resistance of the metal belt layer (the electromagnetic induction heat-generation layer) 1. A calorific value Q generated here is determined by the density of a magnetic flux passing through the metal belt layer (the electromagnetic induction heat-generation layer) 1. The temperature of the nip part N is adjusted by controlling a feeding amount of current to the exciting coil 318 by means of a temperature-adjusting system comprising a temperature sensing means (not shown), so that a predetermined temperature can be kept. In an embodiment shown in FIG. 4, a temperature sensor 326 is a thermistor for detecting the temperature of the fixing belt 310, and the temperature of the nip part N is controlled on the basis of information for the temperature of the fixing belt 310, which is measured with the temperature sensor 326.

A pressure roller 330 as a pressure member is constituted by a mandrel 330*a* and an elastic layer 330*b* made of a heat resistant elastic material such as a silicone rubber, a fluorine-containing rubber and a fluorine resin, which covers the outer circumferential surface of the mandrel to form a concentrically integrated roller shape. The pressure roller 330 is disposed so that both ends of the mandrel 330*a* can be rotatably held in a bearing between the unshown chassis side plates of a device.

Between both the ends of the pressing rigid stay 322 and spring shoe members (not shown) on the chassis side of the device, each contracted pressure spring (not shown) is installed, and makes the pressing rigid stay 322 exert a depressing force. Thereby, the lower surface of a sliding plate 340 arranged under the lower surface of a belt guide member 316 and the upper surface of the pressure roller 330 are compressed to each other while sandwiching a fixing belt 310, and form a nip part N having a predetermined width. Here, a material used for forming the belt guide member 316 is preferably a resin superior in heat resistance, such as a heat resistant phenol resin, a LCP (liquid crystalline polyester) resin, a PPS (polyphenylene sulfide) resin, and a PEEK (polyetheretherketone) resin.

The pressure roller 330 is rotationally driven by a driving means M in a counterclockwise direction as shown by an arrow. By friction between the pressure roller 330 and the fixing belt 310, caused by the rotational drive of the pressure roller 330, a rotating force acts on the fixing belt 310, and the fixing belt 310 rotates outside the belt guide 316, while the inner face slides under the lower surface of the sliding plate 340 in the nip part N, in a clockwise direction as shown by an arrow, at a peripheral velocity corresponding to the rotational peripheral velocity of the pressure roller 330.

Thus, the pressure roller 330 is rotationally driven, and along with it, the fixing belt 310 is rotated. When an electric power is supplied from an excitation circuit (not shown) to an exciting coil (not shown), heat is generated in the fixing belt 310 by electromagnetic induction as described above so that the temperature of the nip part N is raised to a predetermined temperature and the temperature is controlled. In this state, a recording material P which has been transported from an image-forming part and has an unfixed toner image t formed thereon, is introduced between the pressure roller 330 and the fixing belt 310 in the nip part N, with an image face upward, specifically, facing to a fixing belt face. Then, in the nip part N, the image face is brought into close contact with the outer surface of the fixing belt 310, and the recording material is sandwiched and transported together with the fixing belt 310 through the nip part N. In the course of the process, the unfixed toner image t is heated by a generated heat in the fixing belt 310 by electromagnetic induction, and is heat-fixed on the surface of the recording material P. When the recording material P passes through the nip, the material P is separated from the outer surface of the fixing belt 310, is discharged and transported.

The toner image which has been heated and fixed on the recording material is cooled after passing through the nip part N and is converted into a permanently fixed image. In the present embodiment, an oil coating mechanism for preventing offset is not installed in the fixing device, but the oil coating mechanism may be installed in the case of using a toner containing a low-softening substance. On the other hand, in the case of using a toner containing no low-softening substance, a recording material P may be coated with oil and cooled, and then separated, discharged and transported.

The pressure member 330 is not limited to a fixing member having a roller shape, such as a pressure roller, but can be a fixing member having another shape, such as a rotating film type. In addition, for the purpose of feeding thermal energy to the recording material P also from the pressure roller 330 side, a heat-generating device such as that of an electromagnetic induction heating type may also be installed on the pressure roller 330 side to constitute an apparatus construction in which a predetermined temperature can be achieved by heating and temperature control.

EXAMPLES

The present invention will be now described in further detail with reference to Examples below.

As will be described in the Examples and the Comparative Examples, an endless metal belt with an inside diameter of 18 mm and a thickness of 20 μm or 25 μm was produced. On the endless metal belt, a silicone rubber layer with a thermal conductivity of $5.0\times10^{-3}$ W/cm·° C. and a hardness of 10 degrees (JIS-A) was formed in a thickness of 300 μm, and further a PFA tube with a thickness of 25 μm was covered through an adhesive to prepare a fixing belt of 250 mm long.

In addition, an analysis method for the composition of a nickel alloy of the obtained endless metal belt, a measurement method for the half-value width of an X-ray diffraction peak, an idling durability test method with the use of a heat fixing device provided with an obtained fixing belt, and an actual machine endurance paper feeding test method with an image-forming apparatus mounting the heat fixing device, will be described below.

(Analysis Method for Composition of Nickel Alloy Constituting Endless Metal Belt)

The contents of nickel and the additional metallic elements in the nickel alloy of an endless metal belt in the Examples and the Comparative Examples were quantitatively analyzed with the use of a fluorescent X-ray analysis instrument of RIX3000 model (a trade name) made by Rigaku Corporation. In addition, the additional metallic element (manganese and the like) contained in a small amount in the nickel alloy was quantitatively analyzed with the use of an inductively coupled plasma atomic emission spectrometer (ICP Vista-PRO; a trade name) made by Seiko Corporation.

In addition, the contents of non-metallic elements such as sulfur and carbon contained in the nickel alloy were measured by a combustion infrared absorption method with the use of CS-444 model analyzer (a trade name) made by LECO Corporation in the U.S. The analysis precision of the analyzer for sulfur and carbon was confirmed to be 1 ppm (0.0001% by weight).

(Method for Measuring Half-Value Width of X-Ray Diffraction Peak of Nickel Alloy of Endless Metal Belt)

The half-value widths of X-ray diffraction peaks for crystal planes (111) and (200) of a nickel alloy of endless metal belts in the Examples and the Comparative Examples were measured with the use of an X-ray diffractometer (wavelength: 1.54059 angstrom, a trade name: X-ray diffractometer of RINT2000 model, made by Rigaku Corporation).

(Idling Durability Test)

A heat fixing device for evaluation was prepared by mounting the fixing belt in the Examples or the Comparative Examples on the above described heat fixing device of a belt-heating system of a heater heating type. An idling durability test was carried out by using the heat fixing device under the conditions described below.

While the heater temperature of the heat fixing device was controlled to 220° C., the pressure roller was pushed to the fixing belt by applying a predetermined pressurizing force to make the fixing belt rotation-driven by means of the pressure roller. As the pressure roller was used a pressure roller with an outside diameter of 30 mm which was prepared by covering an elastic layer made of a silicone rubber of 3 mm thick with a PFA tube of 30 μm. The conditions in the idling durability test were set to 200 N for the pressurizing force, 8 mm by 230 mm for the area of nip part, and 100 mm/s for the surface velocity of the fixing belt. Here, 0.9 g of a grease (trade name: HP300 made by Dow Corning Asia Ltd.) was applied between the inner surface of the fixing belt and the sliding plate when the fixing belt is mounted. In the present idling durability test, the load torque of the pressure roller needed for the roration-driving of the fixing belt was measured at the same time.

Under the idling durability test, the time till cracking and fracture start occurring on the fixing belt was visually observed, and was defined as an endurance time.

The minimum endurance time of the fixing belt which is calculated from the safety factor and the process speed of the heat fixing device requires 250 hours, but the endurance life (an endurance time) of the fixing belt according to the present invention was set to 500 hours or longer, as a guide for evaluating the durability.

(Actual Machine Endurance Paper Feeding Test)

The actual machine endurance paper feeding test of 100,000 or more image-reproduction was performed by means of an image-forming apparatus in which the heat fixing device used in the above described idling durability test was mounted on full-color LBPLASER SHOT LBP-2040 (trade name) made by Canon Inc.

In the actual machine endurance paper feeding test, the pressurizing force of a pressure roller was set to 200 N, the area of nip part to 8 mm by 230 mm, the fixing temperature to 200° C. and the process speed to 100 mm/s; and 0.9 g of a grease (HP300 made by Dow Corning Asia Ltd.; a trade name) was applied between the inner surface of the fixing belt and the sliding plate, when the fixing belt is mounted.

Evaluation was made by reproducing a predetermined number of images, making subsequent visual inspection of the obtained images by five evaluators, and using evaluation results of three or more evaluators. The evaluation criteria are as follows:

○: Remarkable gloss unevenness did not occur in comparison with the initial stage image.

x: Remarkable gloss unevenness occurred in comparison with the initial stage image.

Example 1

A nickel electrolytic bath was prepared which contained 450 g/l (concentration) of nickel sulfamate, 75 g/l of cobalt sulfamate, 7 g/l of nickel bromide, 7 g/l of cobalt bromide, 30 g/l of boric acid, 0.02 g/l of a stress-reducing agent (saccharin sodium), and 3 g/l of a pitting prevention agent (trade name: Pitless S, made by Nihon Kagaku Sangyo Co., Ltd.).

An endless metal belt of 25 μm thick was prepared by forming a nickel alloy film in a predetermined thickness on the surface of a master block made from stainless steel as a cathode, under conditions of pH 4 of the above described nickel electrolytic bath, 50° C. of the electrolytic bath temperature, and 6 A/dm$^2$ of the current density, and peeling the film off.

The nickel alloy of the endless metal belt contained 10% by weight of cobalt, 0.02% by weight of sulfur and 0.01% by weight of carbon.

On the outer circumferential surface of the obtained endless metal belt, a silicone primer (trade name: DY35-067, made by Toray and Dow Corning Ltd.) was applied and dried by a well-known method to form a primer layer of about 1 μm thick; and through the primer layer, a liquid silicone rubber material which is prepared so as to make the heat conduction to be $5.0\times10^{-3}$ W/cm·° C., was coated and heat-hardened by a well-known method to form an elastic layer made of the silicone rubber of 300 μm thick. On the outer circumferential surface of the elastic layer, a silicone adhesive (trade name: TSE3205, made by GE Toshiba Silicones Ltd.) to form an adhesive layer, and a PFA tube of 25 μm thick was simultaneously covered, heated and bonded to form a release layer, thereby producing a fixing belt.

The composition of the nickel alloy of the obtained endless metal belt, half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 2

An endless metal belt of 25 μm thick was prepared in the same manner as in Example 1 except for using a nickel electrolytic bath containing 450 g/l of nickel sulfamate, 150 g/l of cobalt sulfamate, 7 g/l of nickel bromide, 7 g/l of cobalt bromide, 30 g/l of boric acid, 0.02 g/l of a stress-reducing agent (saccharin sodium), and 3 g/l of a pitting prevention agent (Pitless S: made by Nihon Kagaku Sangyo Co., Ltd.). With the use of the endless metal belt, a fixing belt was prepared in the same manner as in Example 1. The nickel alloy of the endless metal belt contained 20% by weight of cobalt, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 3

An endless metal belt of 20 μm thick was prepared in the same conditions as in Example 1 except for using a nickel electrolytic bath containing 450 g/l of nickel sulfamate, 200 g/l of cobalt sulfamate, 7 g/l of nickel bromide, 7 g/l of cobalt bromide, 30 g/l of boric acid, 0.02 g/l of a stress-reducing agent (saccharin sodium), and 3 g/l of a pitting prevention agent (Pitless S: made by Nihon Kagaku Sangyo Co., Ltd.). With the use of the endless metal belt, a fixing belt was prepared in the manner as in Example 1. The nickel alloy of the endless metal belt contained 40% by weight of cobalt, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 4

An endless metal belt of 25 μm thick was prepared in the same manner as in Example 1 except for using a nickel electrolytic bath containing 450 g/l of nickel sulfamate, 150 g/l of cobalt sulfamate, 30 g/l of manganese sulfamate, 7 g/l of nickel bromide, 7 g/l of cobalt bromide, 30 g/l of boric acid, 0.02 g/l of a stress-reducing agent (saccharin sodium), and 3 g/l of a pitting prevention agent (Pitless S: made by Nihon Kagaku Sangyo Co., Ltd.). With the use of the endless metal belt, a fixing belt was prepared in the same manner as in Example 1. The nickel alloy of the endless metal belt contained 20% by weight of cobalt, 0.2% by weight of manganese, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 5

An endless metal belt of 25 μm thick was prepared in the same manner as in Example 1 except for using a nickel electrolytic bath containing 10.8 g/l of nickel sulfate, 32.3 g/l of sodium tung-state, 36.5 g/l of a reducing agent (citric acid), 0.02 g/l of a stress-reducing agent (saccharin sodium), and 3 g/l of a pitting prevention agent (Pitless S: made by Nihon Kagaku Sangyo Co., Ltd.) and except for employing the conditions of pH 6.5 of the nickel electrolytic bath, 65° C. of the electrolytic bath temperature and 5 A/dm$^2$ of the cathode current density. With the use of the endless metal belt, a fixing belt was prepared in the same manner as in Example 1. The nickel alloy of the endless metal belt contained 30% by weight of tungsten, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 6

An endless metal belt of 20 μm thick was prepared in the manner as in Example 5, and with the use of the endless metal belt, a fixing belt was prepared in the same manner as in Example 1. The nickel alloy of the endless metal belt contained 30% by weight of tungsten, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Example 7

An endless metal belt of 25 μm thick was prepared in the same manner as in Example 1 except for using a nickel electrolytic bath containing 16.2 g/l of nickel chloride, 159.3 g/l of stannous chloride, 165.2 g/l of potassium pyrophosphate, 18.8 g/l of glycine of a pH buffer, 0.03 g/l of a stress-reducing agent (saccharin sodium), and 3 g/l of a pitting prevention agent (Pitless S: made by Nihon Kagaku Sangyo Co., Ltd.) and except for employing the conditions of pH 8 of the nickel electrolytic bath and 1 A/dm$^2$ of the cathode current density. With the use of the endless metal belt, a fixing belt was prepared in the manner as in Example 1. The nickel alloy of the endless metal belt contained 45% by weight of tin, 0.005% by weight of sulfur and 0.015% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 1

An endless metal belt of 25 μm thick was prepared in the same manner as in Example 1 except for using a nickel electrolytic bath containing 450 g/l of nickel sulfamate, 5 g/l of cobalt sulfamate, 7 gil of nickel bromide, 7 g/l of cobalt bromide, 30 g/l of boric acid, 0.02 g/l of a stress-reducing agent (saccharin sodium), and 3 g/l of a pitting prevention agent (Pitless S). With the use of the endless metal belt, a fixing belt was prepared in the same manner as in Example 1. The nickel alloy of the endless metal belt contained 3% by weight of cobalt, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 2

An endless metal belt of 25 μm thick was prepared in the same manner as in Example 1 except for using a nickel electrolytic bath containing 450 g/l of nickel sulfamate, 270 g/l of cobalt sulfamate, 7 g/l of nickel bromide, 7 g/l of cobalt bromide, 30 g/l of boric acid, 0.02 g/l of a stress-reducing agent (saccharin sodium), and 3 g/l of a pitting prevention agent (Pitless S). With the use of the endless metal belt, a fixing belt was prepared in the same manner as in Example 1. The nickel alloy of the endless metal belt contained 60% by weight of cobalt, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 3

An endless metal belt of 25 μm thick was prepared in the same manner as in Example 1 except for using a nickel electrolytic bath containing 16.2 g/l of nickel chloride, 189.6 g/l of stannous chloride, 165.2 g/l of potassium pyrophosphate, 18.8 g/l of glycine of a pH buffer, 0.03 g/l of a stress-reducing agent (saccharin sodium), and 3 g/l of a pitting prevention agent (Pitless S) and except for employing the conditions of pH 8 of the nickel electrolytic bath and 1 $A/dm^2$ of the cathode current density. With the use of the endless metal belt, a fixing belt was prepared in the same manner as in Example 1. The nickel alloy of the endless metal belt contained 60% by weight of tin, 0.005% by weight of sulfur and 0.015% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 4

An endless metal belt of 25 μm thick was prepared in the same manner as those in Example 1 except for using a nickel electrolytic bath containing 10.8 g/l of nickel sulfate, 58.8 g/l of sodium tungstate, 36.5 g/l of a reducing agent (citric acid), 0.02 g/l of a stress-reducing agent (saccharin sodium), and 3 g/l of a pitting prevention agent (Pitless S) and except for employing the conditions of pH 6.5 of the nickel electrolytic bath, 65° C. of the electrolytic bath temperature and 5 $A/dm^2$ of the cathode current density. With the use of the endless metal belt, a fixing belt was prepared in the same manner as in Example 1. The nickel alloy of the endless metal belt contained 60% by weight of tungsten, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 5

An endless metal belt of 25 μm thick was prepared in the same manner as in Example 1 except for using a nickel electrolytic bath containing 290 g/l of nickel sulfamate, 150 g/l of cobalt sulfamate, 7 g/l of nickel bromide, 7 g/l of cobalt bromide, 404.8 g/l of manganese sulfamate, 30 g/l of boric acid, 0.02 g/l of a stress-reducing agent (saccharin sodium), and 3 g/l of a pitting prevention agent (Pitless S) and except for employing the conditions of pH 4 of the nickel electrolytic bath, 50° C. of the electrolytic bath temperature and 16 $A/dm^2$ of the cathode current density. With the use of the endless metal belt, a fixing belt was prepared in the same manner as in Example 1. The nickel alloy of the endless metal belt contained 20% by weight of cobalt, 1% by weight of manganese, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

Comparative Example 6

An endless metal belt of 25 μm thick was prepared in the same manner as in Example 2 except for employing the conditions of pH 6 of the nickel electrolytic bath and 45 $A/dm^2$ of the cathode current density. With the use of the endless metal belt, a fixing belt was prepared in the same manner as in Example 2. The nickel alloy of the endless metal belt contained 20% by weight of cobalt, 0.02% by weight of sulfur and 0.01% by weight of carbon.

The composition of the nickel alloy constituting the obtained endless metal belt, the half-value widths of X-ray diffraction peaks for crystal planes (111) and (200), the thickness of the endless metal belt, and the results of an idling durability test are summarized in Table 1, and the results of an actual machine endurance paper feeding test are shown in Table 2.

TABLE 1

| | Composition of endless metal belt alloy (% by weight) | Half-value widths of X-ray diffraction peaks (2θ) Crystal plane (111) (degree) | Crystal plane (200) (degree) | Thickness (μm) | Endurance time (hour) |
|---|---|---|---|---|---|
| Example 1 | Ni/Co (90/10) | 0.52 | 0.96 | 25 | 550 |
| Example 2 | Ni/Co (80/20) | 0.76 | 1.11 | 25 | 620 |
| Example 3 | Ni/Co (60/40) | 0.84 | 1.35 | 20 | 880 |
| Example 4 | Ni/Co/Mn (79.8/20/0.2) | 0.75 | 1.15 | 25 | 780 |
| Example 5 | Ni/W (70/30) | 0.80 | 1.38 | 25 | 590 |
| Example 6 | Ni/W (70/30) | 0.80 | 1.38 | 20 | 720 |
| Example 7 | Ni/Sn (60/45) | 0.65 | 1.12 | 25 | 650 |
| Comparative Example 1 | Ni/Co (97/3) | 0.34 | 0.53 | 25 | 250 |
| Comparative Example 2 | Ni/Co (40/60) | 0.9 | 2.1 | 25 | 150 |
| Comparative Example 3 | Ni/Sn (40/60) | 0.8 | 2.3 | 25 | 150 |
| Comparative Example 4 | Ni/W (40/60) | 0.7 | 2.5 | 25 | 220 |
| Comparative Example 5 | Ni/Co/Mn (79/20/1) | 0.85 | 2.2 | 25 | 170 |
| Comparative Example 6 | Ni/Co (80/20) | 0.35 | 0.54 | 25 | 180 |

TABLE 2

| | Result of actual machine endurance paper feeding test | | | |
|---|---|---|---|---|
| | After image-reproduction on 10,000 sheets | After image-reproduction on 30,000 sheets | After image-reproduction on 50,000 sheets | After image-reproduction on 100,000 sheets |
| Example 2 | ○ | ○ | ○ | ○ |
| Example 4 | ○ | ○ | ○ | ○ |
| Example 5 | ○ | ○ | ○ | ○ |
| Example 7 | ○ | ○ | ○ | ○ |

In Examples 1 to 3, the nickel alloy for the endless metal belt contained cobalt in a content ranging from 10% by weight to 40% by weight, and the solid solution effect of cobalt was brought about. The half-value widths of X-ray diffraction peaks for both of crystal planes (111) and (200) were in a range of from 0.5 degrees to 2 degrees. It was verified in the idling durability test that the fixing belt prepared with the use of the endless metal belts had adequate durability on the inner surface side of the fixing belt and both end faces of the fixing belt even after the idling durability test for 500 hours or longer. Particularly, in Example 3, the thickness of the endless metal belt was 20 μm and the fixing belt prepared with the use of the endless metal belt had a further improved flexibility and showed as excellent durability as the endurance time of 880 hours.

In Example 4, the fixing belt showed the endurance time of 780 hours in the idling durability test. The result revealed that in the fixing belt using the endless metal belt in Example 4, the addition of 0.2% by weight of manganese improved the durability in the idling durability test compared to the binary nickel alloy (Example 2).

In Examples 5 and 6, it was confirmed that both the endless metal belts made of the nickel alloy containing 30% by weight of tungsten showed the half-value widths of X-ray diffraction peaks for crystal planes (111) and (200) within a range of 0.5 degrees to 2 degrees, and that both the fixing belts prepared with the use of the endless metal belts had durability of 500 hours or longer in the idling durability test. Particularly, the fixing belt with the use of the endless metal belt of 20 μm thick in Example 6 showed the endurance time of 720 hours or longer. It was assumed that these results were caused by the development of a solid solution effect of the additional metallic element, and that in Example 6, superior durability was brought about by the solid solution effect and the wall-thinning effect.

In Example 7, the endless metal belt made of the nickel alloy containing 45% by weight of tin also showed the half-value widths of X-ray diffraction peaks for crystal planes (111) and (200) in a range of from 0.5 degrees to 2 degrees, and the fixing belt prepared with the use of the endless metal belt had as excellent durability as the endurance time of 650 hours in the idling durability test.

In contrast to these, the endless metal belt made of the nickel alloy containing 3% by weight of cobalt in the Comparative Example 1 showed a half-value width of an X-ray diffraction peak for crystal plane (111) of 0.34 degrees which are smaller than 0.5 degrees, and the fixing belt prepared with the use of the endless metal belt showed the endurance time of 250 hours. In addition, the fixing belt showed inadequate abrasion resistance, so that it also showed a torque-up phenomenon due to friction abrasion in the idling durability test. It is assumed that these results were due to the inadequate development of a solid solution effect.

In the Comparative Example 2, the endless metal belt made of the nickel alloy containing 60% by weight of cobalt showed the half-value width of an X-ray diffraction peak for a crystal plane (200) of 2.1 degrees which exceed 2 degrees, and the fixing belt prepared with the use of the endless metal belt showed the endurance time of 150 hours in the idling durability test, and at the time caused cracking. This result is assumed to have been caused by tensile stress generated by the solute cobalt in the nickel alloy.

In Comparative Example 3, the endless metal belt made of the nickel alloy containing 60% by weight of tin showed the half-value width of an X-ray diffraction peak for a crystal plane (200) of 2.3 degrees which exceed 2 degrees, and the fixing belt prepared with the use of the endless metal belt showed the endurance time of 150 hours in the idling durability test.

In Comparative Example 4, the endless metal belt made of the nickel alloy containing 60% by weight of tungsten showed the half-value width of an X-ray diffraction peak for a crystal plane (200) of 2.5 degrees which exceed 2 degrees, and the fixing belt prepared with the use of the endless metal belt showed the endurance time of 220 hours in the idling durability test. The result is assumed to have been caused by tensile stress generated by the solute tungsten.

In Comparative Example 5, the endless metal belt made of the nickel alloy containing 20% by weight of cobalt and 1% by weight of manganese showed the half-value width of an X-ray diffraction peak for a crystal plane (200) of 2.2 degrees which exceed 2 degrees, and the fixing belt prepared with the use of the endless metal belt showed the endurance time of 170 hours in the idling durability test. The result is assumed to have been caused by the fact that the forcibly solid-dissolved manganese solute has changed the internal stress of the nickel alloy to tensile stress.

In Comparative Example 6, the endless metal belt made of the nickel alloy containing 20% by weight of cobalt showed the half-value widths of X-ray diffraction peaks for crystal planes (111) and (200) of respective 0.35 degrees and 0.54 degrees, of which the half-value width of an X-ray diffraction peak particularly for a crystal plane (111) is small, and the fixing belt prepared with the use of the endless metal belt showed the endurance time of 180 hours. The result is assumed to have been caused by the fact that a solid solution effect does not develop in the nickel alloy obtained under electroforming conditions of the high current density of 45 A/dm$^2$ and the pH value of 6.

As shown in Table 2, it has been recognized that any of image-forming apparatus mounting heat fixing devices provided with fixing belts in Examples 2, 4, 5 and 7 carried out image reproduction on 100,000 sheets without causing any trouble, completed the actual machine endurance paper feeding test, and had superior endurance in feeding paper.

INDUSTRIAL APPLICABILITY

The endless metal belt according to the present invention has superior flexing resistance and adequate durability due to the solid solution effect, and the fixing belt according to the present invention, which is produced with the use of the endless metal belt shows superior durability even when used as a fixing belt with a small diameter, and a heat fixing device provided with the fixing belt according to the present invention has superior durability.

This application claims priority from Japanese Patent Application No. 2003-382461 filed on Nov. 12, 2003, which is hereby incorporated by reference herein.

What is claimed is:

1. The endless metal belt comprising an electroformed nickel alloy, the nickel alloy containing 5% by weight or more of an additional metallic element, wherein said electroformed nickel alloy is a solid solution, and has a half-value width of an X-ray diffraction peak in a range of from 0.5 degrees to 2 degrees for each of a crystal plane (111) and a crystal plane (200), wherein the additional metallic element is at least one element selected from the group consisting of Co, Mn, Sn, W, Cu and Zn.

2. The endless metal belt according to claim 1, wherein the additional metallic element is at least one element selected from the group consisting of Co, Mn, Sn and W.

3. The endless metal belt according to claim 1, wherein the content of the additional metallic element in the nickel alloy is 5 to 50% by weight.

4. The endless metal belt according to claim 1, wherein the nickel alloy contains at least one non-metallic element selected from the group consisting of sulfur and carbon, and is produced by electroforming.

5. The endless metal belt according to claim 4, wherein the content of the non-metallic element in the nickel alloy is 0.002 to 0.05% by weight.

6. The endless metal belt according to claim 1, wherein the thickness of the endless metal belt is 10 to 100 μm.

7. The endless metal belt according to claim 6, wherein the thickness of the endless metal belt is 15 to 60 μm.

8. A fixing belt comprising an endless metal belt according to any one of claims 1 to 7.

9. The fixing belt according to claim 8, further comprising an elastic layer on the endless metal belt.

10. The fixing belt according to claim 8, further comprising a release layer on the outer circumferential surface side of the fixing belt.

11. The fixing belt according to claim 8, further comprising a release layer on the outer circumferential surface side of the fixing belt, and an elastic layer between the release layer and the endless metal belt.

12. A heat fixing device for heat-fixing an unfixed image held on a recording material in a nip part formed between a pair of fixing members at least one of which has a belt shape, while sandwiching and transporting the recording material, wherein the fixing member having a belt shape is an endless metal belt according to claim 1.

13. The heat fixing device according to claim 12, further comprising a heater for heating the fixing member having a belt shape.

14. The heat fixing device according to claim 12, further comprising a magnetic field-generating means for heating the fixing member having a belt shape by electromagnetic induction.

* * * * *

UNITED STATES PATENT AND TRADEMARK OFFICE

CERTIFICATE OF CORRECTION

PATENT NO. : 7,215,916 B2
APPLICATION NO. : 10/982902
DATED : May 8, 2007
INVENTOR(S) : Kazuo Kishino et al.

It is certified that error appears in the above-identified patent and that said Letters Patent is hereby corrected as shown below:

COLUMN 2
Line 37, “patent” should read --Patent--.

COLUMN 3
Line 42, “fixing-device” should read --fixing device--.

COLUMN 5
Line 4, “can-be” should read --can be--.

COLUMN 10
Line 22, “is used” should read --is used as--.
Line 28, “blow.” should read --below.--.
Line 52, “has:” should read --has--.

COLUMN 15
Line 36, “roration-driving” should read --rotation driving--.

COLUMN 17
Line 50, “tung-state,” should read --tungsten,--.

COLUMN 23
Line 5, “electrofromed” should read --electroformed--.

Signed and Sealed this

Twentieth Day of May, 2008

JON W. DUDAS
*Director of the United States Patent and Trademark Office*